US010398920B2

(12) United States Patent
Meredith

(10) Patent No.: US 10,398,920 B2
(45) Date of Patent: Sep. 3, 2019

(54) EXERCISE WEIGHT SELECTION DEVICE AND METHOD

(71) Applicant: Jeffrey Owen Meredith, Del Mar, CA (US)

(72) Inventor: Jeffrey Owen Meredith, Del Mar, CA (US)

( * ) Notice: Subject to any disclaimer, the term of this patent is extended or adjusted under 35 U.S.C. 154(b) by 313 days.

(21) Appl. No.: 15/404,109

(22) Filed: Jan. 11, 2017

(65) Prior Publication Data

US 2017/0120097 A1 May 4, 2017

Related U.S. Application Data

(63) Continuation-in-part of application No. 14/633,052, filed on Feb. 26, 2015, now abandoned.

(60) Provisional application No. 61/945,008, filed on Feb. 26, 2014.

(51) Int. Cl.

| | |
|---|---|
| ***A63B 21/06*** | (2006.01) |
| ***A63B 21/00*** | (2006.01) |
| ***A63B 21/062*** | (2006.01) |
| *A63B 24/00* | (2006.01) |

(52) U.S. Cl.

CPC .... *A63B 21/00072* (2013.01); *A63B 21/0616* (2015.10); *A63B 21/0626* (2015.10); *A63B 21/159* (2013.01); *A63B 21/00065* (2013.01); *A63B 21/0632* (2015.10); *A63B 21/154* (2013.01); *A63B 21/4043* (2015.10); *A63B 24/0087* (2013.01)

(58) Field of Classification Search

CPC ..... A63B 21/00072; A63B 21/00076; A63B 21/0615–0617; A63B 21/063151; A63B 21/152; A63B 21/154; A63B 21/159; A63B 21/4047

See application file for complete search history.

(56) References Cited

U.S. PATENT DOCUMENTS

| | | | |
|---|---|---|---|
| 1,547,268 | A | 7/1925 | Sotomayor |
| 3,638,941 | A | 2/1972 | Kulkens |
| 3,905,599 | A | 9/1975 | Mazman |
| 4,387,894 | A | 6/1983 | Baumann |
| 4,426,077 | A | 1/1984 | Becker |
| 4,753,437 | A | 6/1988 | Lapcevic |
| 4,982,956 | A | 1/1991 | Lapcevic |
| 4,988,095 | A | 1/1991 | Ferrari |
| 5,230,680 | A | 7/1993 | Wu |
| 5,263,914 | A | 11/1993 | Simonson et al. |
| 5,733,229 | A | 3/1998 | Dalebout et al. |
| 6,685,607 | B1 | 2/2004 | Olson |

(Continued)

OTHER PUBLICATIONS

International Searching Authority, International Search Report and Written Opinion for International Application No. PCT/US2018/012905, dated May 8, 2018, 7 pages.

*Primary Examiner* — Joshua Lee

(74) *Attorney, Agent, or Firm* — Gordon Rees Scully Mansukhani LLP; David R. Heckadon

(57) ABSTRACT

A resistance component configured for imparting a resistive force to a connected exercise component is provided. The device includes a frame pivotally supporting a selection arm which has a weight operatively connected to the selection arm by a pin arm. The weight imparts a force resisting rotation of the selection arm by a flexible member engaged with the exercise component. Adjusting the engagement of one end of the pin arm to an arched engagement path along the selection arm adjusts mechanical advantage and the resistive force.

32 Claims, 12 Drawing Sheets

(56) References Cited

U.S. PATENT DOCUMENTS

| | | | |
|---|---|---|---|
| 7,097,590 | B2 | 8/2006 | Canali |
| 7,357,765 | B1 | 4/2008 | Watson et al. |
| 7,695,417 | B2 | 4/2010 | Canali |
| 7,976,441 | B2 | 7/2011 | Ellis |
| 8,033,967 | B2 | 10/2011 | Canali |
| 8,172,729 | B2 | 5/2012 | Ellis |
| 8,216,116 | B2 | 7/2012 | Canali |
| 8,388,504 | B2 | 3/2013 | Ellis |
| 8,864,636 | B1 | 10/2014 | Danowski et al. |
| 9,682,271 | B2 | 6/2017 | Canali |
| 2003/0027693 | A1 | 2/2003 | Bushnell |
| 2004/0157709 | A1 | 8/2004 | Olson |
| 2004/0185988 | A1 | 9/2004 | Hsiung et al. |
| 2004/0254050 | A1 | 12/2004 | Morgan |
| 2005/0049121 | A1 | 3/2005 | Dalebout et al. |
| 2005/0049122 | A1 | 3/2005 | Vallone et al. |
| 2005/0239603 | A1 | 10/2005 | Canali |
| 2006/0019807 | A1 | 1/2006 | Husted et al. |
| 2006/0084555 | A1 | 4/2006 | Garner |
| 2007/0142187 | A1 | 6/2007 | Kolomeir |
| 2012/0010055 | A1 | 1/2012 | Webb et al. |
| 2013/0137557 | A1 | 5/2013 | Canali |
| 2015/0238801 | A1 | 8/2015 | Meredith |
| 2017/0120097 | A1 | 5/2017 | Meredith |

EXERCISE WEIGHT SELECTION DEVICE AND METHOD

This application is a Continuation in Part Application from U.S. patent application Ser. No. 14/633,052 filed on Feb. 26, 2015 which claims the benefit of U.S. provisional application No. 61/945,008 filed on Feb. 26, 2014, both of which are incorporated herein in their entirety by this reference thereto.

FIELD OF THE INVENTION

The present device relates to exercise equipment employed for muscle strengthening. More particularly, the disclosed device and method, relate to a weight lifting device configured for easy resistance adjustment through the provision of an arched member having an easy user-adjustable connection thereto to an underlying weight. A plurality of apertures are positioned across the arched member for insertion of a pin which concurrently adjusts a position on the curved member which communicates variable lifting force from mechanical advantage to the underlying weight. Operatively employing the device herein, when coupled with any external exercise interface such as a handle, a user may easily initially select and re-select a preferred weight resistance for a particular exercise, and repetitively employ the weight to provide resistance to their exercise with little noise or machine wear.

BACKGROUND OF THE INVENTION

Body building and physical fitness equipment employ a variety of forms. All of which are adapted to provide resistance to user muscle exertion, exercise, and to build muscle tissue during an exercise regime. In recent years, weight "machines" have become popular as they can be configured to provide a plurality of positions and exercises at different stations or configurations of the machine. In each exercise, a cable running a serpentine route communicates resistance from weights to the component being pushed, pulled, or lifted by the user. A plethora of weight selection module systems have been developed with such machines. All in an attempt to allow a user to variably select an aggregate weight using a group of weights which are operatively engaged to the distal end of the cable and are employed to provide resistance for each workout. Users conventionally choose a weight combination to yield the aggregate amount of weight resistance based on their individual strength, exercise routine, and workout tactics.

Weight lifting machines are often composed of two mating and interchangeable components. First, a resistance module provides the exercise load to provide resistance to the user movement during exercise. A second component interface provides the operative engagement of one or a plurality of weights with the cable and enables the user to apply a determinable force to the station or machine to exercise a defined muscle or muscle group.

Employing the conventional weight stack resistance module, as seen in U.S. Pat. No. 7,871,357, a user typically selects their desired lifting load, by inserting a pin through a vertical rod, which communicates through one of multiple layers of metallic plates. A positioning of the pin in a particular point on the rod causes the engaged plate to support overhead plates when elevated and thereby determines the aggregate amount of weight engaged to the cable from the plurality of weight plates selected through placement of the pin.

Generally, the weight plates each contain at least one or a plurality of bore holes positioned to guide the plates during translation on aligned rods communicating through the bore holes. One through-bore hole communicates vertically through a central portion of the thickness of the plates between the top surface to the bottom surface. In use, this centrally located bore hole surrounds an inserted translating vertical rod. This rod, along with any supported weight plates in operative engagement, translates along a vertical path when moved by a user gripped or engaged exercise. The weight of the engaged weight plates, thus, provide the resistance to movement of the interfacing component by the user, such as a barbell type component or the like.

Conventionally, a pair of outer through-bore holes, which lie symmetric about the centrally located hole in each weight plate, are slidably engaged about vertically inclined support bars which, during use, constrain the weight plates from rotating. An engagement aperture conventionally communicates horizontally through the width of each weight plate between the top and bottom surfaces and intersects the middle through-bore.

Rod apertures communicating into the translating vertical rod, sequentially spaced to be aligned with a complimentary spacing of the engagement apertures running through each weight plate when positioned in a stack. To choose a resistive load for use with any particular exercise component using the weight stack for resistance, a pin is user-engageable through any single engagement aperture to also engage a rod aperture in the vertical translating rod. Thus, the user, by engaging the bottom weight in the stack to the rod, will have a resistance weight of all the weights in the stack when the vertical rod translates. The resistance weight may be adjusted by engaging the pin through the engagement aperture of a weight plate higher in the stack and vice versa. However, this system has a number of shortcomings.

First, as noted, the system employs a selector pin which must be moved to different engagement apertures of differently positioned weight plates in the stack. As with any loose engagement device, the selector pin is easily lost if it is not tethered to the machine. Should the tether fail, the selector pin, in a gym environment with many different users, tends to become lost or is moved to other weight stacks which also have lost selector pins. Additionally, the pin can become worn and hard to insert.

Further, in a commercial gym environment misuse of the weight system through improper selector pin insertion or mis-engagement can bend the selector pin. In either case a damaged or lost selector pin can cripple the entire machine engaged to a particular weight stack.

Other problems can occur over time, even where the selector pin remains proximate to a weight stack and used property. Because the translating rod engaging the weight stack is frequently engaged to a cable which tends to elongate over repeated use to lift the load of weights engaged to the rod, misalignment frequently occurs between the engagement apertures in the weight plates, and the translating vertical rod. Such can make it difficult if not impossible to properly position the selector pin through a chosen weight plate and aperture in the translating rod. This can disable the exercise machine engaged to the weight stack, or at least make it irksome and more time consuming to use.

Other issues exist with conventional weight stack engaged exercise machines which, while not mechanically impairing the operation of the machine, can be annoying and even injurious to the user. During translation of the weight stack during use from a stack-supported position and back, the metal weight plates contact each other and cause significant noise and over time significant wear. Additionally, a significant risk of injury is always present during use of weight stack resistance exercise machines. This is because a pinch point exists between the lowest weight in the plurality lifted by rod translation and the weight plate upon which the translating stack lands. The pinch point can cause severe injury to the user of the exercise machine, or more often, to a third party who places a digit between the non moving weight and the weight stack being lowered by translation of the rod downward.

Several advancements have been made to reduce the inadequacies of the pin and weight stack system, such as the leverage-weight machines. Leverage weight machines allow the user to adjust the mechanical advantage to tune a static load, providing the user-chosen resistance without removable pins. This has proven much easier and safer for users by eliminating the use of an external pin altogether and reducing dangerous pinch points, and potential poor pin engagement which can cause raised stacks of weights to release.

Leverage machines are based on the principal that increasing or decreasing the applied moment arm through which the user lifts a given constrained weight, increases or decreases the work required by the body of the user and thus increases or decreases the resistance to movement. Thus, the force necessary to perform the exercise by the user may be increased or decreased.

In an example of a leverage weight machine, U.S. Pat. No. 5,263,914 allows the user to adjust the mechanical advantage by employment of a system of pulleys and cables which lift a singular or static amount of weight. U.S. Pat. Nos. 7,537,552 and 8,323,158 employ a similar technique by replacing the weight-based load source with biasing sprung bands and resistive pneumatics respectively.

While these current leverage style weight machines reduce the need for a variable weight stack and engaging pin, such leverage systems employ a complicated pulley arrangement and serpentine cabling system, along with a multitude of moving parts inherent to such complicated designs. The employment of numerous cables, rotating pulleys, and other moving parts frequently renders such machines noisy, costly, difficult to maintain. Further, the presence of numerous cables running over numerous pulleys increases injury potential through the formation of numerous potential pinch points of the cables and pulleys. Unlike weight stack pinch points, users unfamiliar with cable and pulley operation are frequently unaware of the potential for injury.

As such, there is an unmet need for a resistive weight apparatus which alleviates the shortcomings of prior art weight resistive devices. Such a device should be simple to manufacture, build and maintain to thereby reduce costs and encourage widespread sales to encourage users to exercise. Such a system should be constructed with an arrangement of components which render it quiet, which would be especially helpful in a gym environment with multiple concurrent users of multiple exercise machines. Ideally, the potential for injury should be reduced by eliminating or reducing the number of potential pinch points in the device and system. Further, unlike the current pin and weight stack systems, which locate the weight stack a distance from the engaged exercise device and generally near the floor, such a device should include a means for user choice of resistance which is easily viewed and which allows the user to easily and quickly calculate, and adjust the desired resistance load yielded for their particular exercise routine. Further, unlike conventional cable and pulley systems and weight stacks which require a considerable amount of floor space due to their configuration, such a device should ideally allow for use in a small footprint of floor space.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device and system herein disclosed and described provides a solution to the shortcomings in prior art and achieves the above noted objects through the provision of an exercise resistive device and system which is engageable to exercise machines to yield smooth resistance to exercise movements through the employment of a weight load which eliminates jerking or jumping or noise upon landing. Further, as disclosed, the device is configured with significantly reduced appendage pinch and crush points lessening injury risks thus providing the user with a quiet and easily tunable workout apparatus.

In accordance with one preferred mode of the device, the device employs a housing frame minimizing pinch points configured to bear the load of and balance a weight or weights engaged thereto. The housing has sufficient height to ensure that the engaged weight can be displaced a sufficient distance during the exercise stroke of an engaged exercise machine being employed by a user. The housing is depicted in a rectangular or square shape although this may vary. The housing may include securement plates, which allow for engagement to a supporting surface for added stability. Engagement of the resistance device herein to any exercise machine employable by a user requiring a resistive force, is by a cable thereby allowing the device herein to be easily retrofitted to existing gym equipment and easily engaged to new equipment.

A weight operatively engaged with the frame of the device is engaged about a pivot point or bearing which allows the weight to rotate about the pivot point supported by the housing frame. The axis of the body of the elongated weight running through first and second side surfaces, is generally operatively engaged to the frame to pivot in a plane running normal to the plane of the floor or the support surface, along the long axis of the frame.

At the pivot point for the weight, a bearing or aperture is engaged with a bearing in a pin arm. The weight itself can be composed of any heavy, safe, durable material or combination of materials suitable for the purposes set forth in this disclosure. Solid metal may be employed, or a weight formed of a metal, fiberglass, plastic, or polymeric exterior housing which defines an interior cavity which may filled with a material having the mass to yield the total weight thereto. Such could be anything from ball bearings, to dirt, to fluid such as water, or other filler for the internal cavity as would occur to those skilled in the art.

With the device engaged by the flexible member or cable to an exercise component, the user may easily select a desired resistance communicated to the particular exercise component from the cable communicating between the exercise component and the weight of the device herein. Selection of a level of resistance is accomplished by manipulating the connection between a pin arm engaged at a first end to an arched member and in an engagement or operative communication at a second end to the weight. The pin arm contains an aforementioned bearing engaged with the weight itself at the second end, or a secondary member engaged with the weight. A user-engageable pin such as a selection pin is positioned at the first end.

To select a desired resistance level communicated by the cable to the exercise component, a positioning of the pin to engage with one of a plurality of apertures in an array thereof formed in an arched member is employed. The sequentially located apertures communicating into the arched member defining a selection arm, when engaged by the pin to the pin arm, will yield a communication of sequentially more or less resistance by the cable to the exercise station engaged, depending upon the individual aperture to which the user engages the pin.

The arched member forming the resistance selection arm is engaged at a pivoting point, preferably with a bearing at an engagement end, to rotate about an upper support shaft which is operatively engaged with the housing frame. A flexible member such as the noted cable, or a band, or rope, or other flexible member extends along an operative path vertically from an engagement to the second or distal end of pin arm or resistance selection arm, from a pivoted engagement at a first end to the frame. This flexible member or cable runs along a formed pathway operatively engaged with a plurality of pulleys positioned in the housing frame. The load from the weight being pivoted upon a supporting arm for the weight, and thus elevated above the support surface, is thereby communicated to the attached exercise equipment in operative communication with the other end of the cable.

By repositioning the pin hole or aperture or other coupling of the pivoting pin arm, which is centered with the arched pathway of apertures in the selection arm, with differing points upon the arched path on the selection arm, the user can adjust the device's mechanical advantage. Thus, the output resistance communicated through the cable to the exercise device may be adjusted by adjusting the engagement of the pin along the arched or curved member. The employment of the arched pathway of apertures, whether on a linear selection arm or a curved or arched selection arm, allows for both smoother operation and an increased number of adjustment points along the path of the arched member. The arched selection arm is preferable also to the increase in ability to form an angled engagement with the weight.

At rest and in the neutral position, the resistance selection arm preferably rests against a padded ledge on the interior face of the housing frame. The padding should be composed of a durable material, preferably silicone or hard rubber, but may be formed from one or more of the following materials: leather, wood, hard plastic. In an alternatively preferred mode, a ledge component, which is made of a more durable and inelastic material, can connect to the housing frame through a spring designed to soften the load of a suddenly dropped weight. This support to the weight minimizes noise on landing.

As resistance weights are often cast in molds and, thus, inherently less precise in their exterior geometry, an alternate preferred mode can simplify the geometry by replacing the embedded bearing at a single point on the weight with two engaged shafts which lie parallel to the bearing. An upper linkage arm and lower linkage arm, which both include a pivot point at each end engaged with the weight, are employed to constrain the motion and path of movement of the weight relative to the frame of the device. The lower linkage arm rotates about both the weight's shaft and the lower frame support shaft. The upper linkage arm rotates about a third parallel shaft embedded within the weight and the upper frame support shaft, whereas the pin selection arm is still constrained to the weight as described above.

As variations of the second preferred mode, the lower and upper linkage arms can lie on the same or opposing sides of the weight for a lower footprint or increased stability respectively.

To reduce shipping weight and allow for a wider available resistance range for the user, the device can be provided without permanently engaged weights in another preferred mode. In this configuration, the position of the weight is replaced by a vertical linkage arm, which mates to the upper and lower linkage arms through two bearing shafts. Above the bearing shaft in the vertical linkage arm that couples with the upper linkage arm, the vertical linkage arm contains an engageable weight shaft adapted to engage with a conventional barbell weight plate in an operative engagement. The weight shaft should be no shorter or longer than necessary to hold the number of barbell plates whose total mass is equal to the device's maximum load capacity.

The housing frame, linkage, pin and resistance selection arms can be composed of one or a combination of the following materials: steel, stainless steel, aluminum, hard plastic or any other materials suitable for the purposes set forth in this disclosure.

In another preferred option, where very precise resistance adjustments are desired, which require very precise weight and mechanical advantage adjustments, a sliding secondary weight may be engaged to the device. The secondary weight is easily translated short distances to provide minute adjustments to the resistance provided by the device. Further, in place of the spring loaded pin, a quieter engagement component may be provided in the form of a translating pin which is lever-operated. In this mode, rotation of a lever engages and disengages a coaxial pin into the apertures provided.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention to provide an exercise device yielding uniform and adjustable resistance for weight lifting exercises.

It is an additional object of this invention to create a quiet, inexpensive, and easily maintainable source of weight-based resistance which is safe and intuitive to employ.

It is yet another object of the invention herein, to provide an arched pathway of apertures engageable with a weight-engaged pivoting arm to provide increased selectively as to the number of weight selections possible.

It is another object of the present invention to provide a weight lifting apparatus which employs only rotary joints to translate the mass providing resistance and which allows the user to modify the applied moment arm through which the user applies load to a single weight, whose motion is constrained by a four bar linkage.

It is a further object of this invention to provide a weight-based resistance exercise component which minimizes the injury hazards from pinch points and minimizes noise.

It is a further object of the invention, through the employment of an arched lifting component engaged to a pivoting weight or mass, to increase adjustment points for resistance while providing smooth even resistance from aligned force vectors on the weight.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion. In the drawings.

Figure 3:
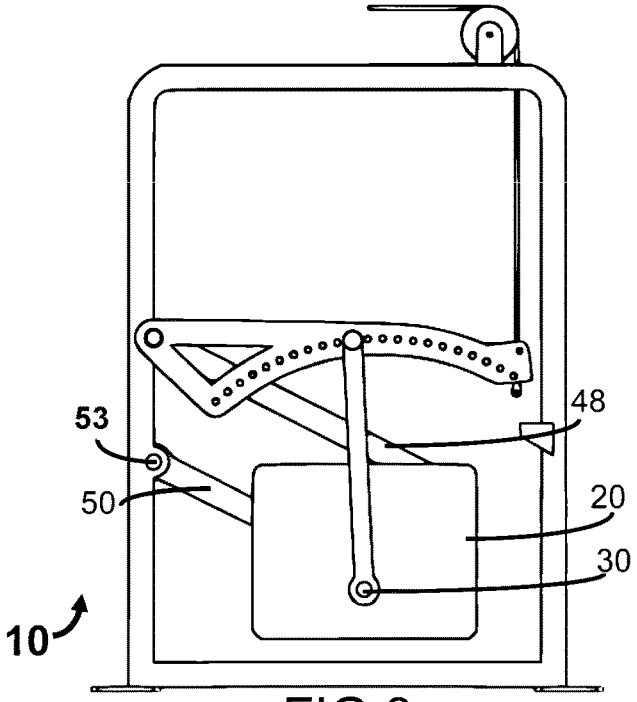

FIG. 3 displays the device in another preferred mode with the weight engaged to a pair of linkage arms on a first side of the weight.

Figure 4:
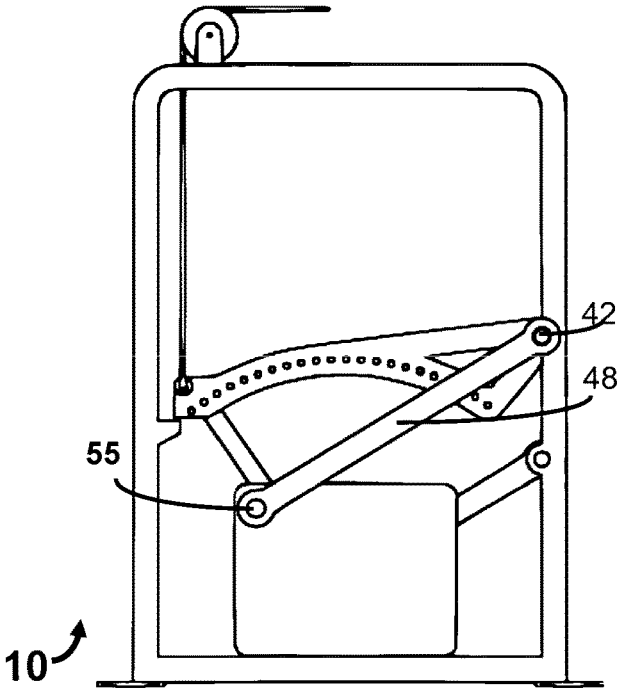

FIG. 4 displays view of a second side of the device of FIG. 3 with the linkage arms on the opposite side of the weight.

Figure 5:
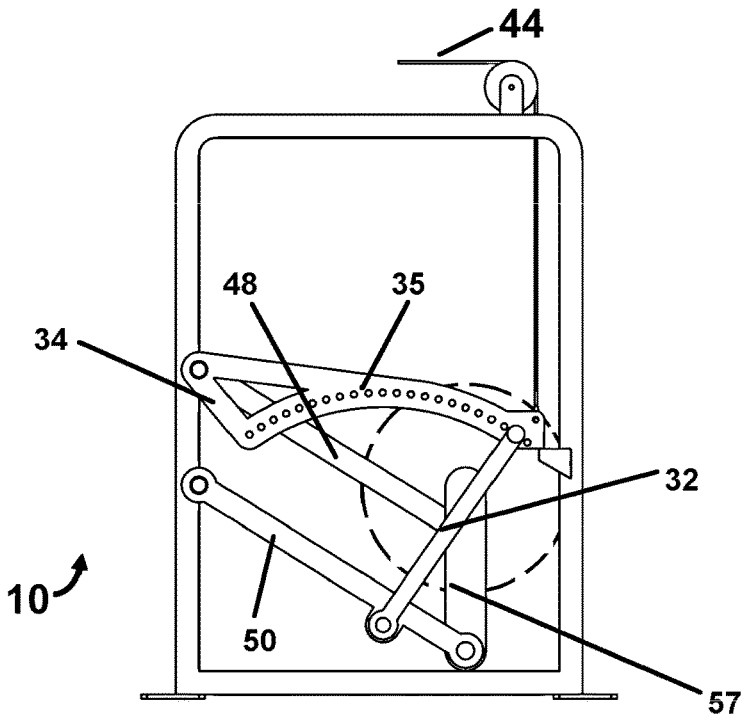

FIG. 5 depicts another preferred mode where the device includes an arched pathway of resistance selection apertures and is configured for engagement of a weight.

Figure 6:
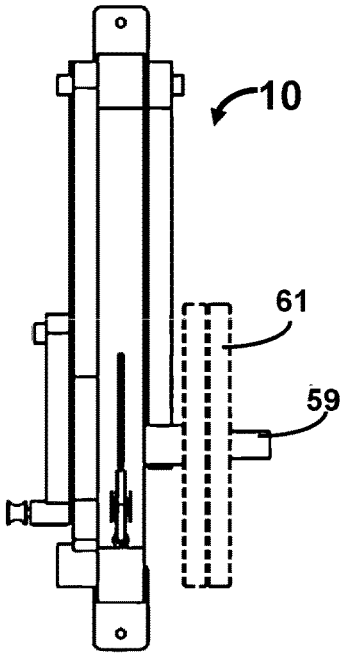

FIG. 6 shows an end view of the device of FIG. 5 depicting a user-engaged weight in dotted line.

Figure 7:
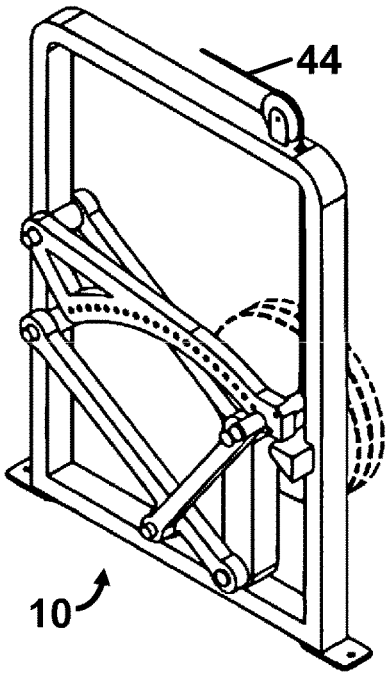

FIG. 7 is a back isometric view of the device of FIG. 5 showing the engagement post for a dumbbell style weight to be engaged on site.

Figure 8:
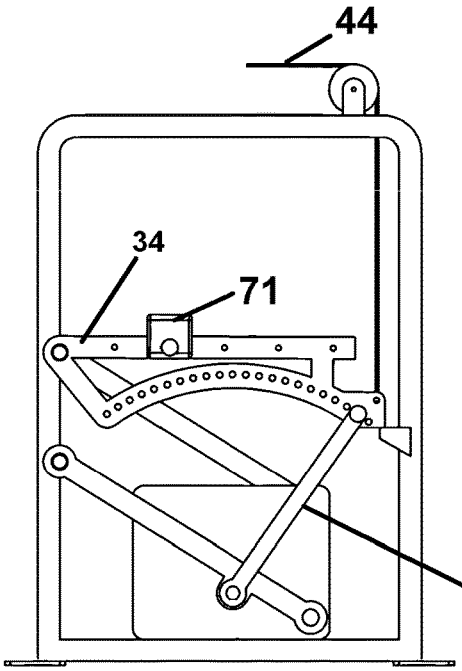
Figure 9:
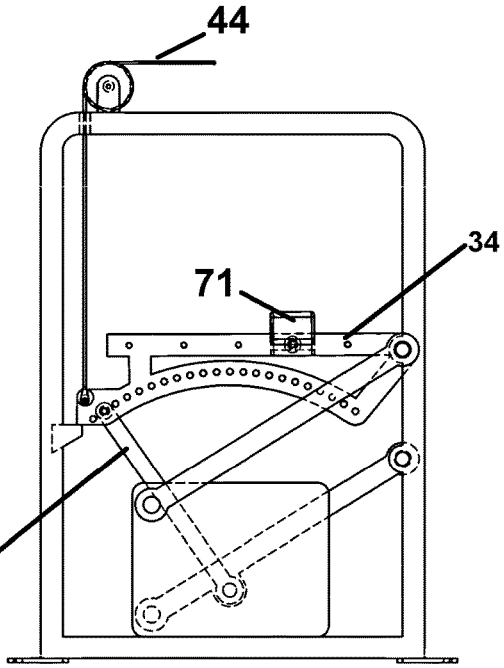
Figure 10:
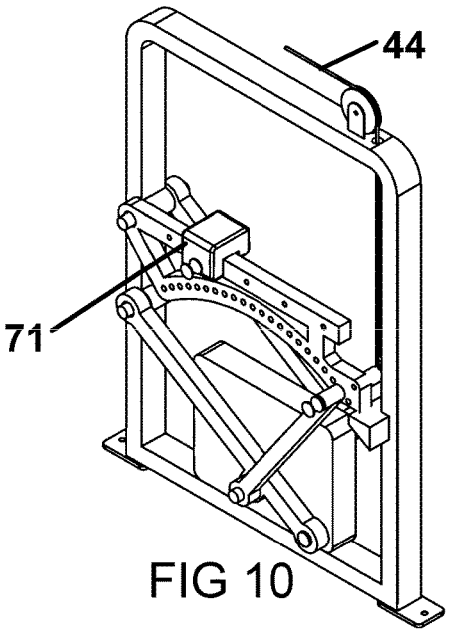

FIG. 8-10 depict a mode of the device which provides a secondary translating weight which is employable for small adjustments to resistance.

Figure 11:
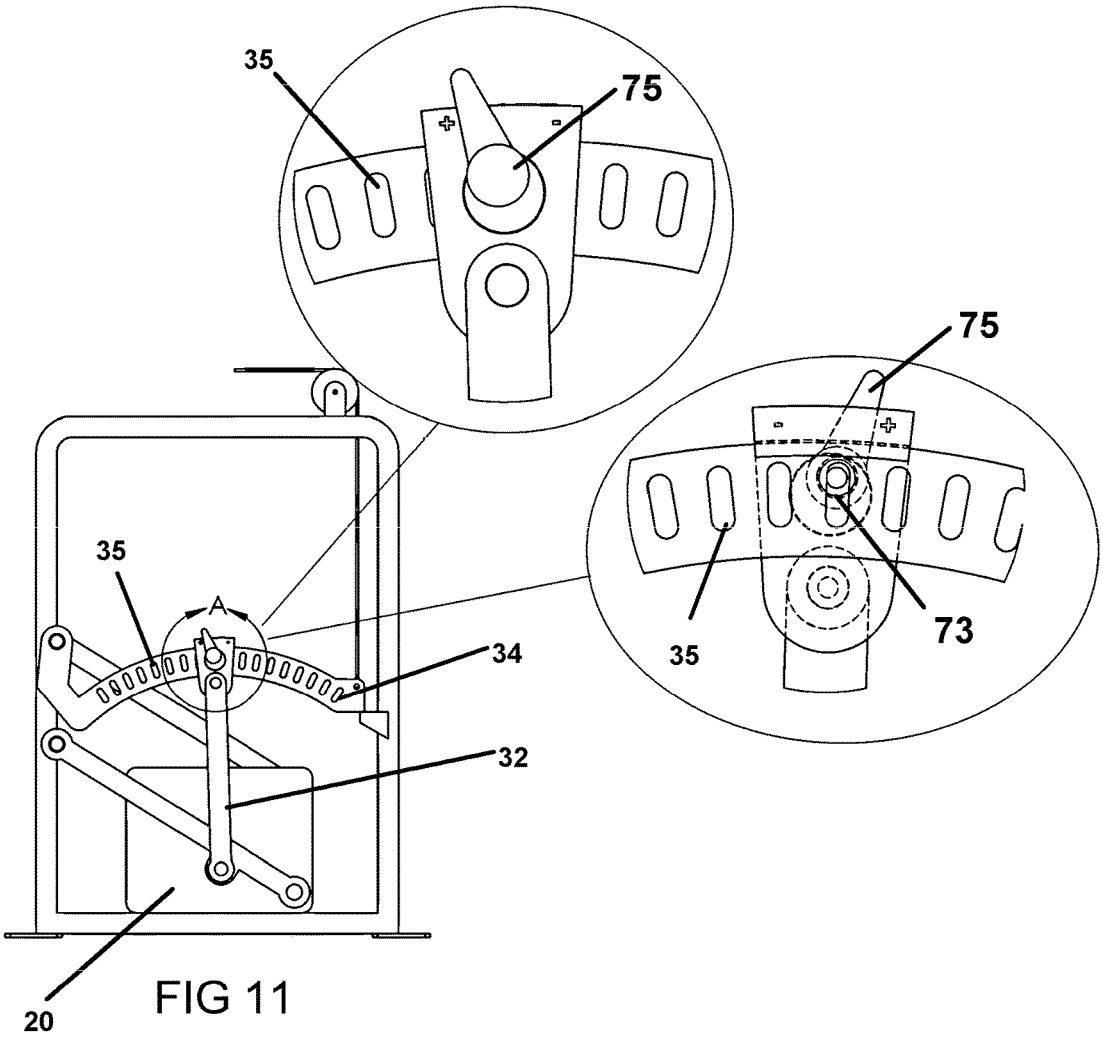

FIG. 11 shows the device having a translating pin which is lever activated for engagement or disengagement.

Figure 12:
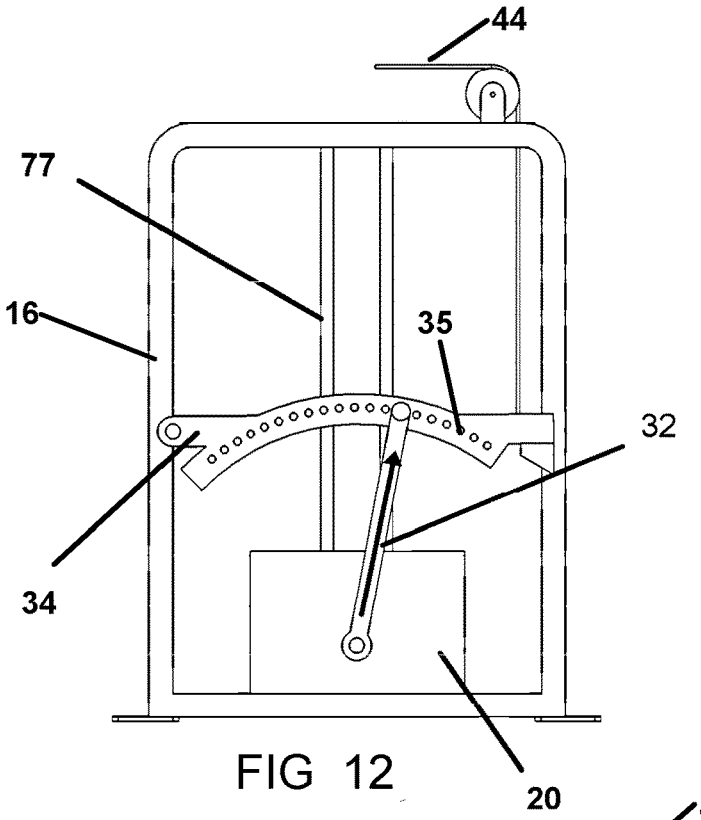

FIG. 12 shows a mode of the device wherein the weight stack tracks upon one or a plurality of vertically disposed rails.

Figure 13:
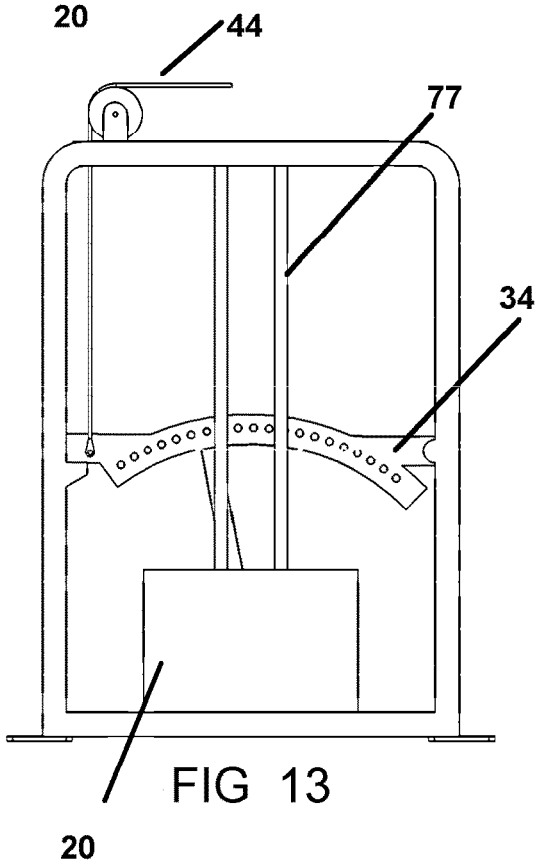

FIG. 13 depicts the rear view of the device of FIG. 13.

Figure 14:
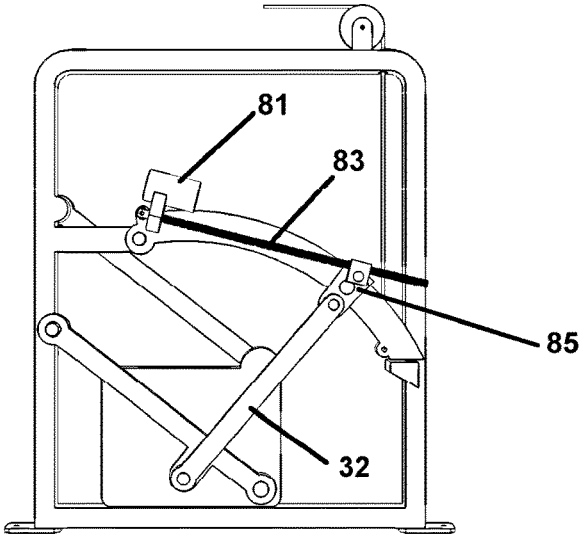

FIG. 14 shows an automatically adjusting mode of the device employing a motor and gear providing means for adjustment of the imparted resistance by the weight stack.

Figure 15:
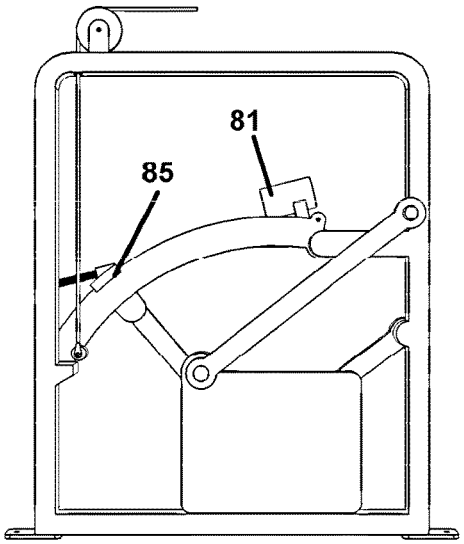

FIG. 15 shows a rear view of the device of FIG. 15.

Figure 16:
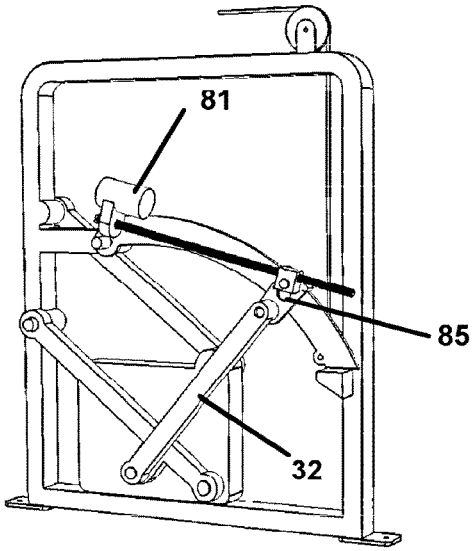

FIG. 16 depicts a perspective view of the device as shown in FIGS. 14-15.

Figure 17:
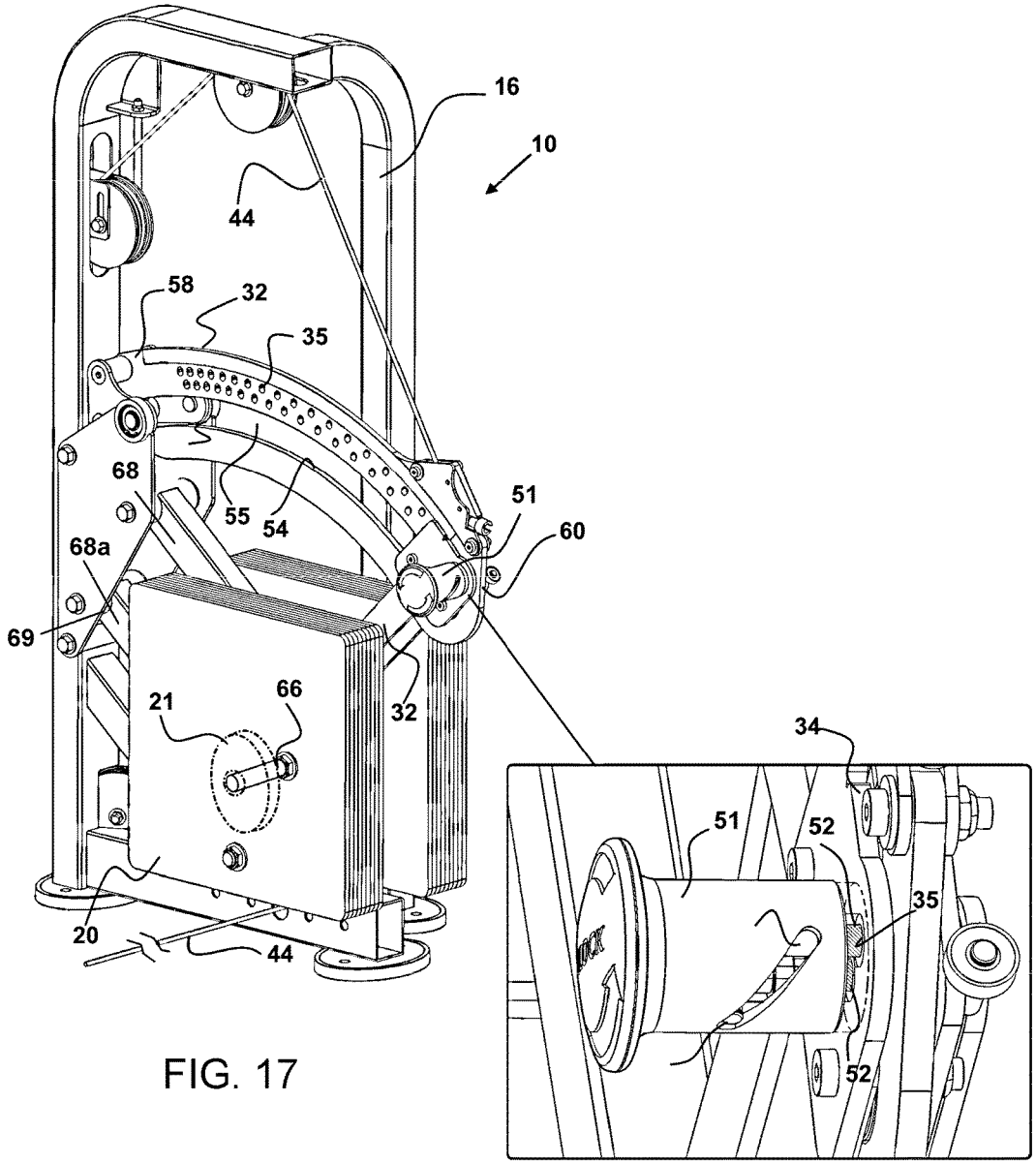

FIG. 17 shows a front perspective view of an especially preferred mode of the device having an arched selection arm with a double row forming paired apertures positioned above a race formed into the selection arm.

Figure 18:
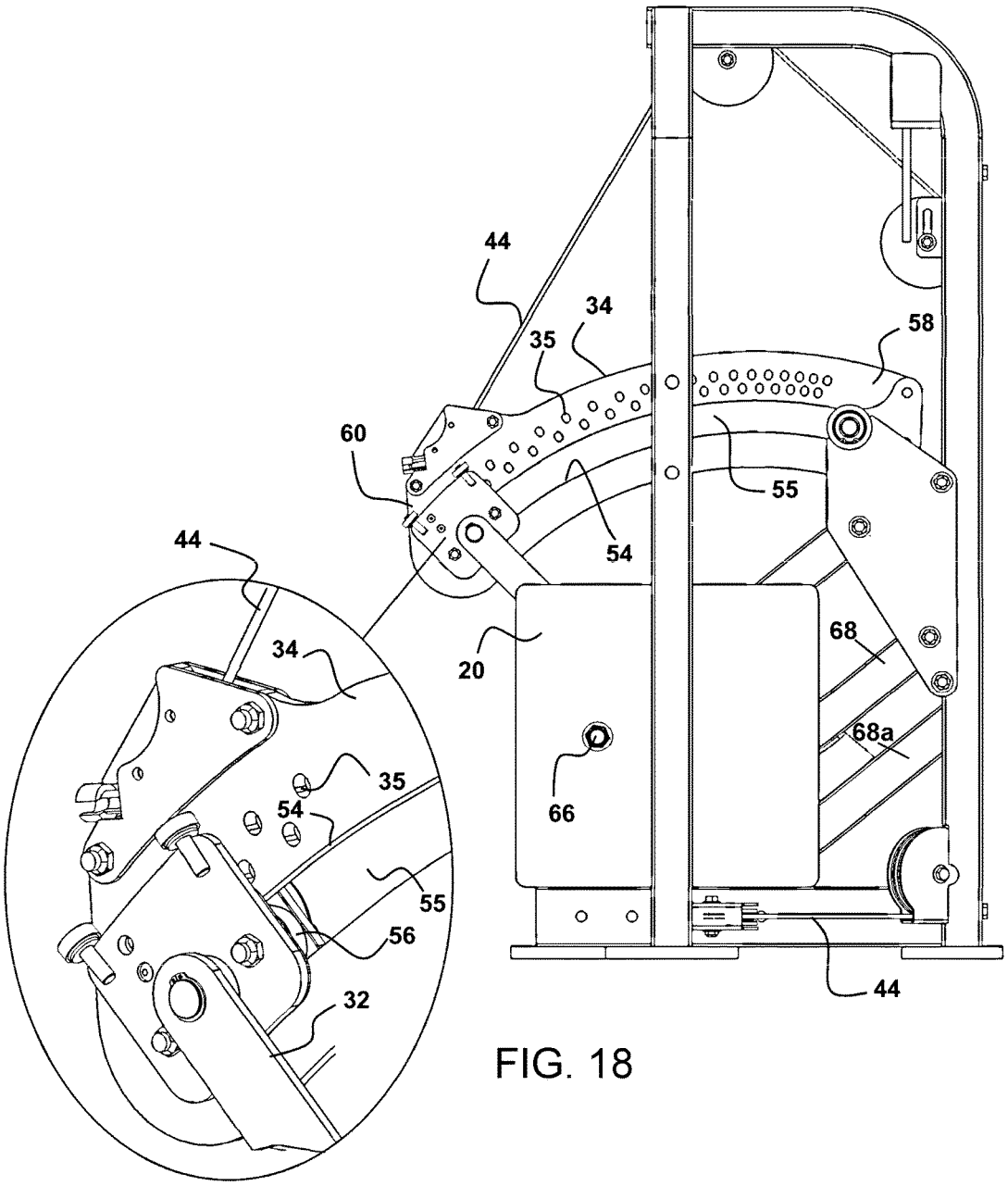

FIG. 18 is a rear plan view of the device as in FIG. 16, showing the plurality of paired apertures positioned to engage with pins located at the distal end of a pin arm.

Figure 19:
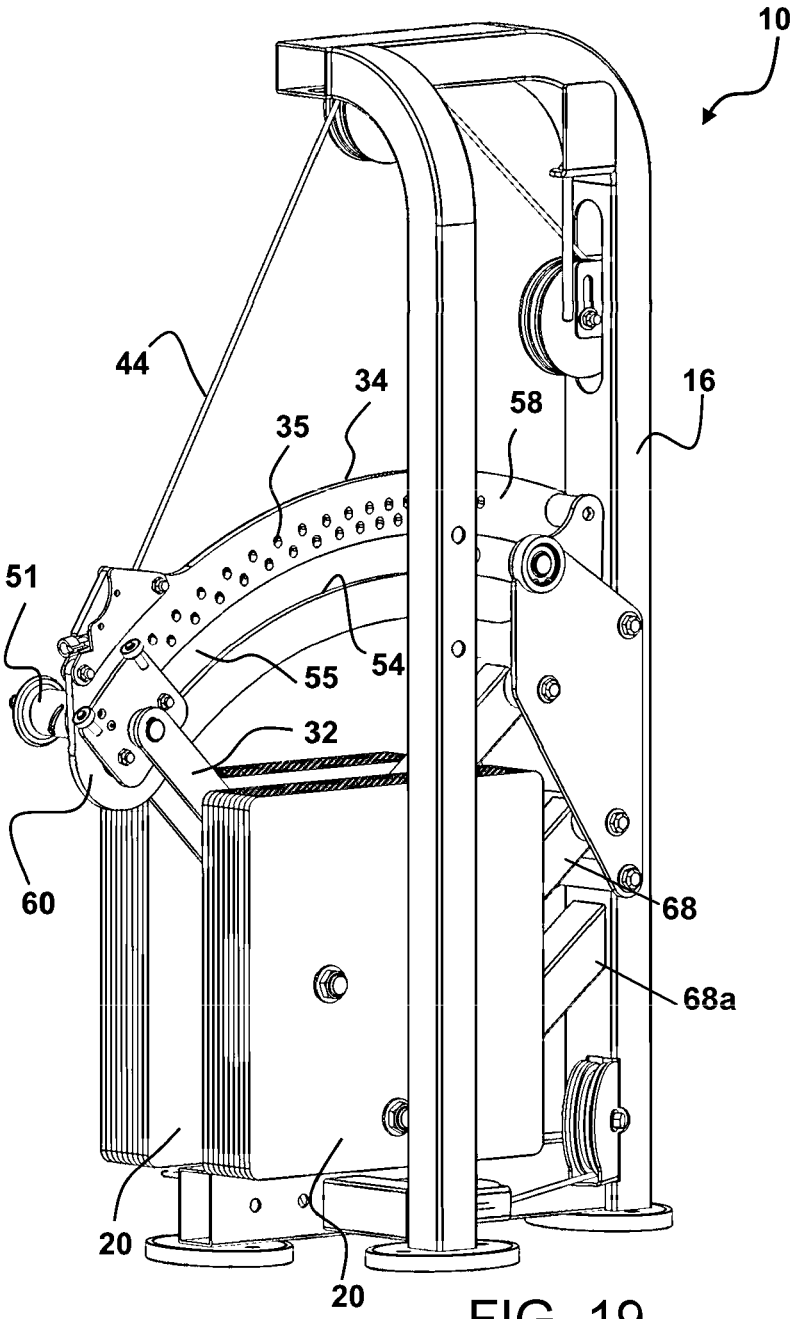

FIG. 19 is a rear perspective view of the device of FIGS. 16-17.

Figure 20:
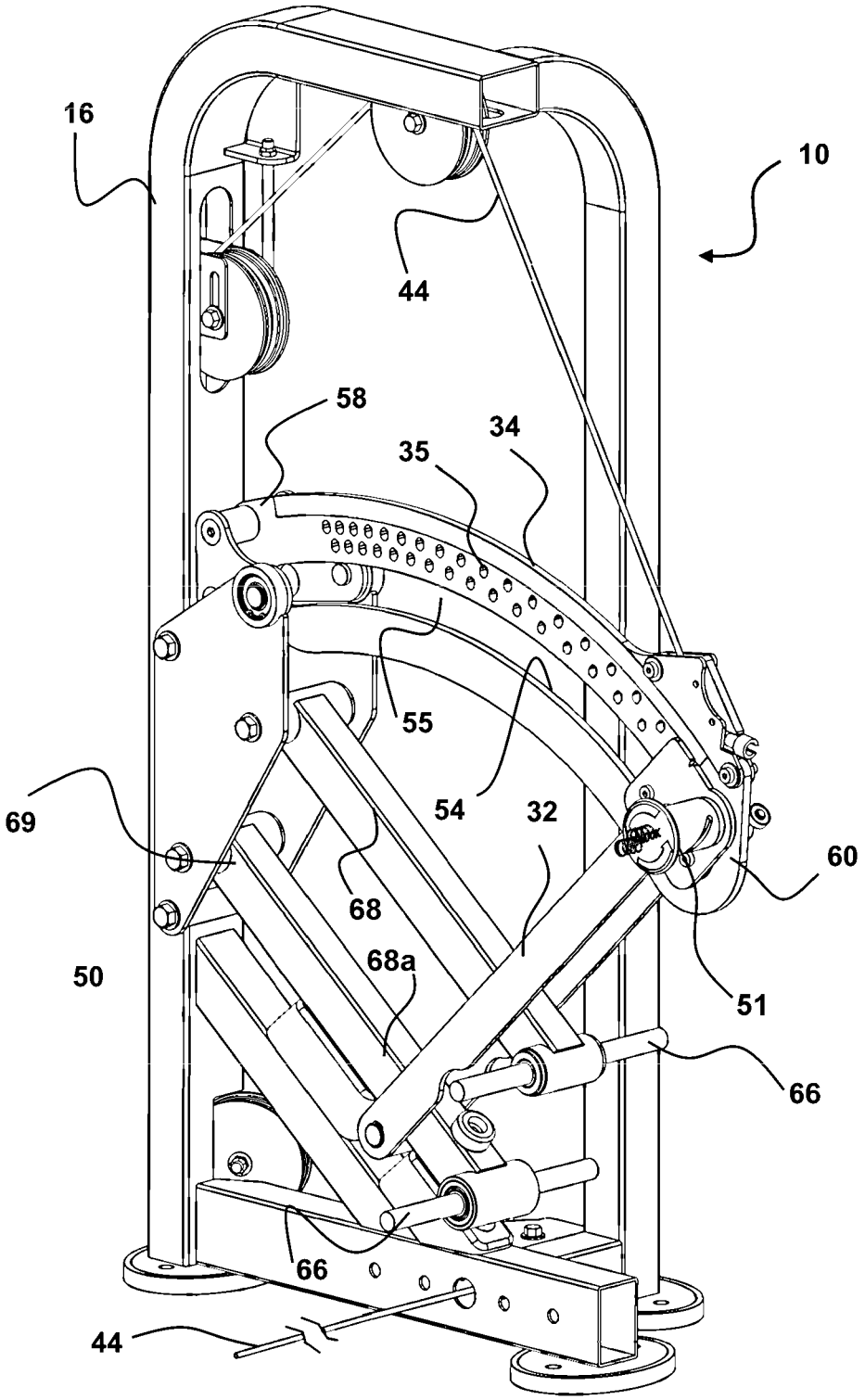

FIG. 20 is another perspective view of the mode of the device of FIG. 16, showing the weights removed and the mounting bars adapted to engage free weights of choice to provide resistance to movement.

Figure 21:
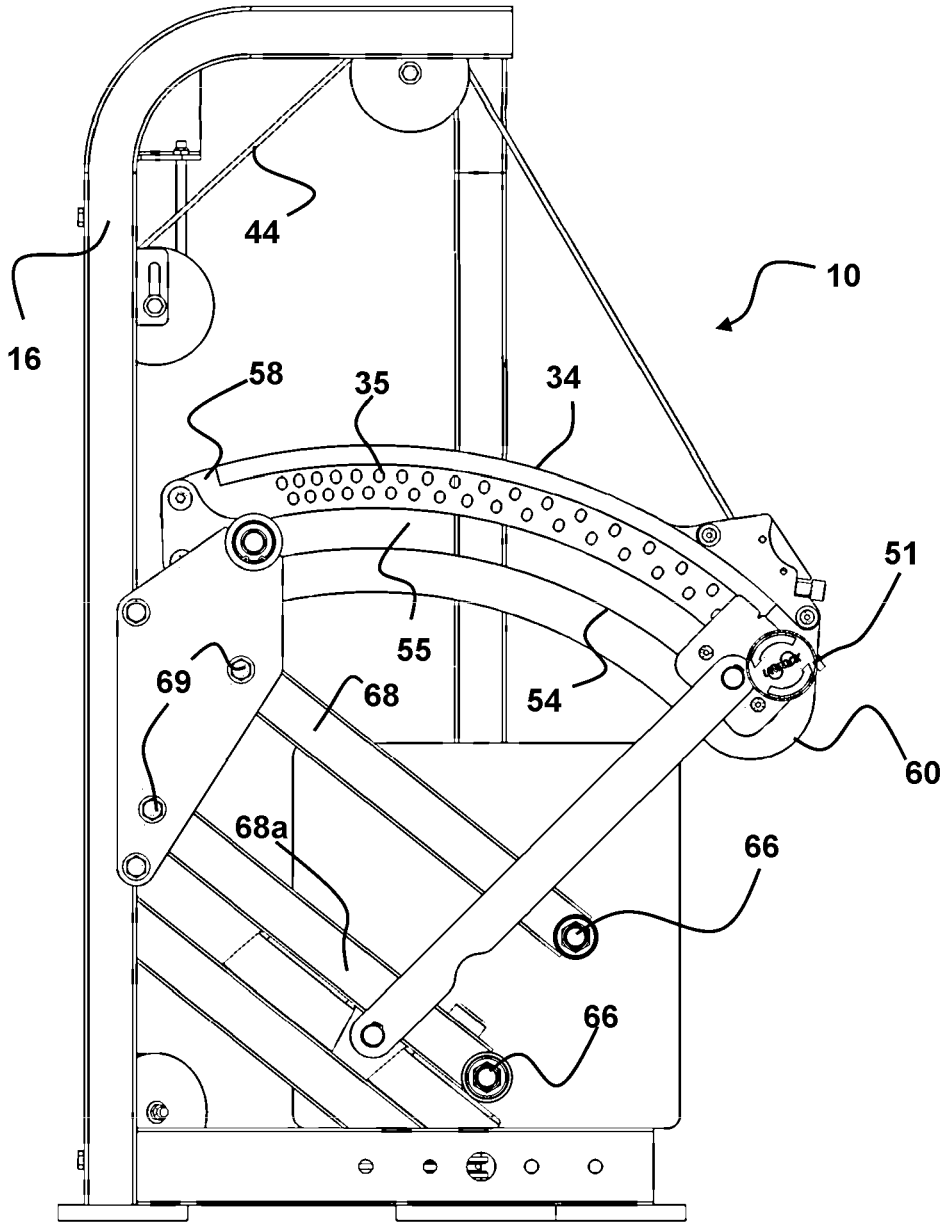

FIG. 21 is an overhead plan view of the front of the device herein of FIGS. 17-20 showing the two curved parallel rows of apertures with sequentially shorter spacing as they approach the first end of the selection arm, and with the apertures of one row positioned in-between pairs of apertures of the other row.

DETAILED DESCRIPTION OF THE INVENTION

The device and system herein disclosed and described in FIGS. 1-21 provide a solution to the shortcomings in prior art of weight stack and resistance exercise components and achieves the above noted goals through the provision of a device and system providing smooth weight resistance during use which eliminates jerking or jumping during use, and further reduces the risk in the present art of appendage pinch and crush risks thus providing the user with a quiet and easily tunable workout apparatus.

Figure 1:
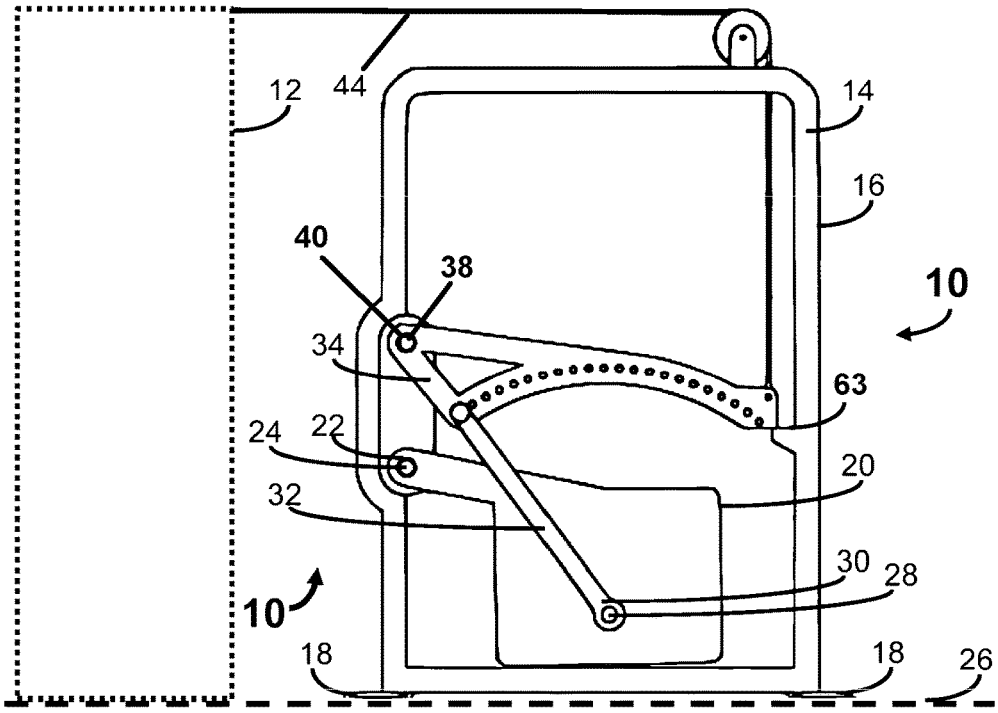
FIG. 1 depicts one preferred mode of the device herein shown employing an arched pathway for connection of a pin arm for variable resistance selection which is set to yield the lowest resistance to cable movement.

In accordance with one preferred mode of the device 10, per FIG. 1, there is operatively engaged a flexible member such as a cable 44 with any exercise component 12 such as handles or pedals or other user-engageable components for pulling or pushing, to operatively engage the device 10 to provide resistance communicated through the cable 44 to an exercise machine. The device 10 employs a support frame 16 shown as a housing 14 to operatively engage the components herein and by doing so, guard against pinch points during operation.

The housing 14 is currently formed between 3 and 5 feet in height above the support surface, to ensure a sufficient pathway for proper weight 20 displacement and translation distance for the cable 44, however such may change depending on the weight 20 employed and the exercise machine to which it engages.

The housing 14 can be constructed of a welded, machined or fastened metal members or tubes to form the rectangular frame 16. Currently the frame 16 has a width of approximately three feet and a height of approximately six feet respectively. It can be formed in a very narrow overall footprint which is only limited by the width of the tubing and as can be seen in FIGS. 6, 7, and 10, which is a distinct advantage over conventional large weight stack devices since the device herein is easily positioned adjacent a wall or in less floor space.

Securement plates 18 may be provided, which allow the owner to bolt the module to the floor or support surface for added stability. However, all of these dimensions are infinitely variable depending upon the size of the weight and room for placement.

A weight 20 pivotally engaged with the device 10 is engaged by a member to an upper pivot point or weight bearing 22, which allows the weight 20 to rotate about a linkage shaft 24 engaged to the housing frame 16. The weight 20 in the mode of FIGS. 1-2, has a pin arm shaft 28 on which a first end of the pin arm 32 will rotate such as a pin arm bearing 30 positioned at a first end of the pin arm 32. Such provides a rotational engagement of a first end of the pin arm 32 to the weight 20. The weight 20 can be composed of any heavy, safe durable material or combination of materials having a mass and dimensions suitable for the purposes set forth in this disclosure.

Figure 2:
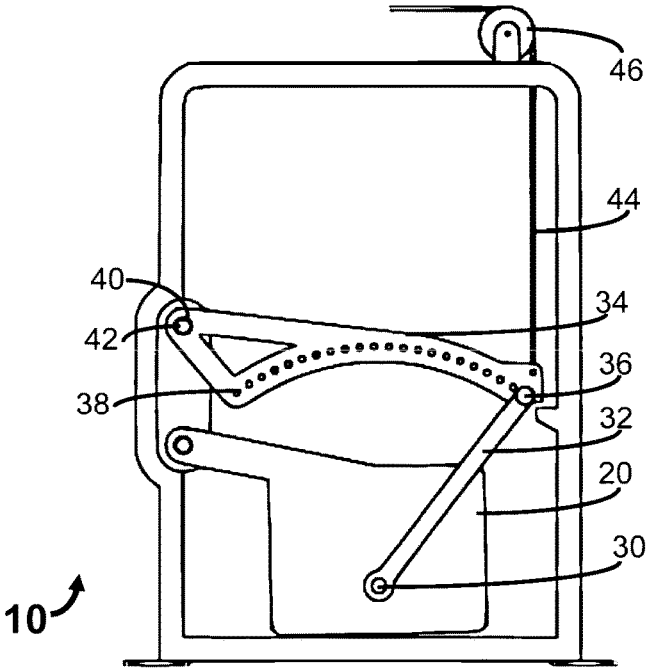
FIG. 2 shows the device of FIG. 1, wherein a pin is set to yield the most resistance to translation of cable movement due to lessened mechanical advantage.

In operation as shown in FIGS. 1 and 2, a user selects the desired resistance communicated to the cable 44 by the weight 20, between a minimum and a maximum force, by manipulating the connection of the second end of the pin arm 32 to an arched pathway of engagement of the second end of the pin arm 32 to points along the selection arm 34 such as apertures 35 spaced along the pin arm 32. While the pin arm 32 might be configured in a linear or straight fashion with the arched pathway of apertures 35 positioned therein, such would render the pin arm 32 more bulky and as such the arched pathway of apertures 35, is preferably formed along a row in a line sequentially spaced along a curved or arched member defining the pin arm 32 as shown herein.

It is this arched pathway for connection of the pin arm 32 to the selection arm 34 such as apertures 35 which is positioned opposite the point of pivoting engagement of the pin arm 32 to the weight 20, or to a member engaged with the weight 20. This arched pathway for engagement such as the apertures 35 and the path followed during rotation of the second end of the pin arm 32, along the same arched pathway defined by apertures 35, allows for significantly increased force adjustment positions as well a much smoother operation and mechanical advantage of the device 10 herein and in all modes herein. The first end of the pin arm 32 will be in a pivoting engagement to frame or to the weight 20 or a member engaged thereto, in a position centered with the arched or curved pathway of engagement to the selection arm 34 such as apertures 35, to allow for the second end of the pin arm 32, to follow the arched pathway and connect to any point there along such as by using apertures 35.

The pin arm 32 as depicted has a pin arm bearing 30 at a first end in a pivoting engagement to the pin shaft 28. The pin arm 32 is of a length to position an aperture through which a selection pin 36 at the second end is engaged, in operative alignment with each of the apertures 35 along the arched pathway of apertures 35 formed into, or engaged with the selection arm 34.

Unlike the weight stack resistance provided by conventional machines, where the resistance is varied by engagement or disengagement of individual weights from a stack, the device 10 herein employs the curved or arched pathway of apertures 35 running sequentially along a curved selection arm 34 for this purpose. A pivoting engagement 38 of a first end of the selection arm 34 on a bearing 40, provides a rotational engagement point, of the selection arm at the first end to or with the frame 16.

The mechanical advantage to elevate the weight 20 and thereby vary resistance communicated to pulling the cable 44, varies along the full length of the selection arm 34 and depending on the engagement point of the second end of the pin arm 32, renders the weight 20, easier or harder to elevate.

Thus, lower resistance to movement of the weight 20 is communicated to the cable 44 and engaged exercise component 12 with the pin arm 32 engaged as shown in FIG. 1 when the second end of the pin arm 32 is engaged to an aperture 35 closest to the bearing 40 and further from the engagement to the cable 44. Engagement of the pin arm 32 to an aperture 35 along the arched pathway of apertures 35 furthest from the resistance arm bearing 40, if selected as in FIG. 2, communicates the resistance from elevating the weight 20, directly to the engaged cable 44 in a substantially straight line, and has little or no mechanical advantage. This creates a higher resistance to translation of the cable 44 which is communicated to an engaged exercise component 12 by the user.

The selection arm 34 as can be seen in FIG. 4, is engaged at a first end pivot point preferably employing a bearing 40 which rotates about an upper support shaft 42 engaged with or supported by the frame 16. It was found after numerous configurations with straight and linear members for the selection arm 34, that a curved member to form the selection arm 34 significantly enhanced the performance of the device 10. As noted, curving the member forming the selection arm is particularly preferred as it provides the most compact manner to form the curved pathway of apertures 35 which provide many more user selectable points of engagement, as well as providing a longer selection arm 34 for increased mechanical advantage in a smaller area than a linear or straight configuration provides.

The cable 44, which can alternatively be replaced with a band, strap or cord, or other flexible member, extends vertically from the resistance selection arm 34, through one or a plurality of cable pulleys 46 in the housing frame 14, which transfers resistance from weight 20 elevation, along the cable 44 and to the attached exercise component 12.

At rest and in the neutral position, the second or distal end of the pin arm 32 rests against a padded ledge 63 on the interior face of the housing frame 14 as shown in FIG. 1. The padding on the ledge 63 should be composed of a durable material, preferably hard rubber, but may be formed from one or more of the following materials: leather, wood, or hard plastic. The padded ledge 63 can also be made of a hard material such as stainless or non-stainless steel or aluminum if the padded ledge 48 is attached to the frame 14 with a spring.

In all modes of the device 10 shown, connection of the weight 20 to the selection arm 34 runs primarily in a line along the pivotally engaged first end of the pin arm 32 at a central point on the weight 20. The second end of the pin arm 32 as noted is selectively engageable to any aperture 35 along the arched pathway of apertures 35 positioned on or engaged with the selection arm 34. Such is especially desirable in that it provides a straight line force along the axis of the pin arm 32 between from the selection arm 34 and the weight 20 no matter where on arched pathway of apertures 35 engaged to the selection arm 34 the pin arm 32 is engaged.

In FIG. 3, the upper weight bearing 22 is substituted with an upper linkage arm 48 and lower linkage arm 50, which both contain a bearing at each end. This mode allows for elevation of the weight 20 as in all modes, but unlike the pivoted frame engagement of FIGS. 1-2, the weight 20 follows a pathway during elevation in a center portion of the frame 16. The lower linkage arm 50 rotates about both the pin arm bearing 30 of the weight 20 and the lower frame support shaft 53. Per FIG. 4, the upper linkage arm 48 rotates about the upper linkage bearing 55, which is parallel to the upper support shaft 42.

As variations in this preferred mode, the lower linkage arm 50 and upper linkage arm 48 can lie on the same or opposing sides of the weight 20 for a lower footprint or increased stability respectively.

In yet another preferred mode of the device 10 herein, per FIGS. 5-7 the device 10 may be constructed to reduce shipping weight and allow for a wider resistance range by configuration allowing use of conventionally available weights and without permanently engaged weights 20. In this configuration, the weight 20 is replaced by a vertical linkage arm 57, which mates to the upper and lower linkage arms 48,50 through two bearing shafts. Above the upper linkage arm 48, the vertical linkage arm 57 contains a long weight shaft 59. The weight shaft 59 is adapted for operative engagement with one or a plurality of conventional barbell weight plates 61 allowing the user increased adjustment since weight plates 61 are removably engageable. The weight shaft 59 should be no shorter or longer than necessary to hold the number of barbell plates whose total mass is equal to the device's maximum load capacity, and in a mode to engaged barbell weight plates 61, preferably have a length and diameter of between 6 and 12 inches, and 2 inches respectively.

Shown in FIGS. 8-10 is an optional mode of the device 10, applicable to all modes herein. As depicted a secondary weight or translating weight 71 is slidably positionable along a path on the selection arm 34, allowing for small adjustments to resistance. A thumb screw or pin and aperture may be used to secure the weight 71 at the desired position for small adjustments in resistance.

In FIG. 11 is shown an optional mode of the device 10 for engagement of the second end of the pin arm 32 to any one of the apertures 35 along the arched pathway thereof. As shown a translating pin 73 which is lever 75 activated for engagement or disengagement with any of the apertures 35. The pin 73 is coaxially engaged with mating threads in the lever 75 such that rotation of the lever 75 one direction will project the pin 73 and in the other direction will retract the pin 73.

Shown in FIGS. 12 and 13 is a mode of the device 10 wherein the weight 20 is engaged to the frame to track upon one or a plurality of vertically disposed rails 77. Operationally, the device 10 like other modes, employs the unique arched pathway for engagement of the pin arm 32 with a plurality connection points for the distal end of the pin arm 32.

FIGS. 14-16 depict an automatically adjusting mode of the device 10 employing a motor 81 and operationally engaged gear 83 providing means for adjustment of the engagement point of the second end of the pin arm 42 along an arched pathway of the selection arm 34. In this mode the selection arm 34 must be formed as an arched member because the second end of the pin arm 32 is in a sliding engagement 85 with the selection arm 34. The motor 81 spinning the gear 83 will translate the sliding engagement of the second end of the pin arm 32 to any point on the arched pathway formed by the arched member defining the selection arm 34. This sliding engagement actuated by the motor 81 allows for automatic resistance adjustment when rotation of the motor 81 rotates the gear 83 which is threadably engaged to the sliding engagement 85 and which will translate along the arch of the selection arm 34 in either direction depending on the rotation direction of the motor 81. This mode of the device 10 allows for a remote control and automatic resistance adjustment to an infinite number of resistance points along the arched pathway of connection of the pin arm 32 to the selection arm 34. It can be adapted to be employed in any mode of the device 10 herein.

Depicted in FIG. 17 is a front perspective view of an especially preferred mode of the device 10. Also shown is an enlarged depiction of the user employable selector 51 which functions to engage and disengage a pin 52 into adjacently positioned apertures 35 formed into an arched pattern along the curved or arched selection arm 34.

In this mode of the device 10, a sliding engagement of the pin arm 32 at or adjacent the distal end of the pin arm 32 with the selection arm is formed. In a preferred mode, the sliding engagement is formed by a race 54 which defined by the sides of a slot 62 formed in the arched selection arm 34 which is sized for a cooperative rolling engagement with a roller 56 operatively connected to the pin arm 32 (FIG. 16). This sliding engagement, such as that formed by the roller 56 positioned at the distal end of the pin arm 32 within the race 54, eliminates the need for a bumper or stop such as the ledge 63 (FIG. 1) for the selection arm 34 as in other modes of the device shown above.

Also shown in the FIGS. 17-20, are the arched member forming the selection arm 34, having a double row of apertures 35 following an arched pathway upon the selection arm 34. In experimentation constructing the device 10 in this mode, it was found that a double row of apertures 35, allowing for the pin 52 to concurrently engage the aperture 35 in either row of apertures 35, that weights 20 could be accommodated by the device 10 with very small increments of resistance change based on the mechanical advantage change provided by positioning a pin 52 in an adjacent aperture 35 engagement of the pin 52. While a single curved row of apertures 35 could be employed for engagement of the pin 52, it was found that such did not perform as well because small increments of effective weight resistance, based on the change in mechanical advantage, could not be provided such as the depicted five pound difference.

By forming two curved rows of apertures 35 along the curved or arched pathway, and staggering the apertures 35 in each row, in-between a pair of apertures 35 in the opposing row, very small changes in effective resistance can be accommodated due to the small changes in mechanical advantage. This is highly desirable to users. Further, it is desirable to also progressively shorten the gap between the apertures 35 of each row of apertures 35, to maintain the one to one lift of the weight in relation to translation of the cable 44, and to allow for the even and small changes in the resistance provided by small changes in mechanical advantage. Such small changes is, currently, a change of four to six pounds with five pounds being a favorite. Thus, an engagement of a pin 52 into each successive aperture 35, along the two rows of apertures 35, provides this even change in resistance to movement, and concurrently maintains the one to one ratio of cable translation to lift distance of the weight.

Still further, it is desirable to limit the distance of rise of the weight, and the distance of travel of the cable. This is further accomplished by forming the lengths of the support arms 68 and 68*a* substantiality equal and at a length between pivots 69 and 66, which is 80-86 percent of the distance of the pin arm 32 running between the pin 52 and the engagement of the second end of the pin arm to the support arm 68*a*. Maintaining these ratios will limit the distance of travel of the cable 44 and concurrent equal distance of the rise and lowering of the weight 20, to substantially 18-22 inches. Currently maximizing this weight travel and cable translation to 20 inches is a particular favored configuration since is works well to allow use of the device 10 in very confined spaces.

Additionally, as noted and as can be seen in FIGS. 17-20, is the decrease in spacing of the apertures 35 in each of the two parallel arched rows of apertures 35, along the arched pathway upon the selection arm 34. As can be seen, the spacing between adjacent apertures 35 as they approach and become closer to the first end 58 of the selection arm 34, in both rows, becomes closer together than the spacing of the apertures 35 from each other at the second end 60 of the selection arm 34. As the apertures 35 become closer to the first end 58 of the selection arm 34, in each of the two arched parallel rows of apertures 35, each aperture 35 in a sequentially positioned arched row of apertures 35, is slightly closer the next subsequent aperture 35 in the sequence, from the previous aperture 35 in the sequence. This occurs in both rows of apertures 35 since the apertures 35 in one row are positioned in-between a pair of apertures 35 in the parallel opposing row, except for the last aperture 35 closest to the first end 58.

This sequentially smaller spacing between the adjacent apertures 35 in the arched row or rows of apertures 35, formed into the selection arm 34, as the apertures become closer to the first end 58 is preferred as noted. This is because the engagement between the pin 52 and one of apertures 35 in either row, at any position along the arched row of apertures 35, forms a connection to with the weight 20, such that a 1 to 1 ratio of rise of the weight 20, to the distance of travel of the cable 44 is maintained, and the changes in force required to raise the weight change in even increments.

Thus, a user pulling a handle engaged to the cable 44 a distance of one foot, will concurrently raise the weight 20, one foot in elevation. This substantially equal rise to travel distance also helps maintain the force required to move the weight 20 at any given pin 52 and aperture 35 engagement along the sequence, equal or the same throughout a given repetition of the user which moves the cable 44, and in equal changed increments from adjacent apertures 35, no matter which individual aperture 35 is engaged by a pin 52.

Shown in the enlarged portion of FIG. 17, is the section handle 51 which has a curved slot 62 slidably engaged with a projecting member 64, which is connected to the pins 52 to translate them into and out of the apertures 35 when aligned therewith. A twist of the handle 51 will cause the projecting member 64 to move toward or away from the selection arm 34, and thus translate one of the pins 52 aligned with an aperture 35 into the aperture 35. A spring (not shown) in between both of the pins 52 and the member 64, allows the member 64 to compress the spring on the engaging pin 52 and force it into the aperture 35 aligned, and to concurrently close a gap between the second pin 52 not aligned with an aperture 35 at the time.

Shown in FIG. 18, is a rear plan view of the device 10 as in FIG. 16, along with an enlarged depiction of the sliding engagement between the distal end of the pin arm 32 and the race 54 defined by the slot formed into the selection arm 34. As can be seen the roller 56 is cooperatively engaged within the slot 55 forming the race 54. As also can be seen, is the sequentially smaller spacing between each aperture 35 in each row of apertures 35 running in an arched pathway on the selection arm 34. As can be seen, the distance between each aperture 35 decreases sequentially as the apertures 35 become closer to the first end 58 of the selection arm 34. The same component arrangement can be seen in the rear perspective view of the device 10 of FIG. 19.

Shown in FIG. 20, is another perspective view of the mode of the device 10 of FIG. 16. As can be seen in this view, the larger weights 20 of FIG. 16 are removed from the mounting members 66 and they are employable with free weights such as those employed on barbells or the like, or other weights having an aperture adapted to engage upon the mounting members 66. These mounting members 66 are also shown in FIG. 16, extending beyond the plate weights 20 to allow smaller extra free weights 21 to be engaged if desired, for small increment resistance changes. Also more clearly shown in FIG. 19, are the support arms 68 and 68*a* which are in a pivoting engagement 69 at first ends with the frame 16, and rotate upward with weight 20 attached when pulled by the translation of the cable 44 when pulled by a user. The translation of the cable 44 is communicated to at least one support arms 68*a* by the pin arm 32 which is connected to the selection arm 34, which as shown connects to the cable 44 at the second end 60. Thus, translation of the cable 44 will move the selection arm 34 and the connected pin arm 32 which rotate at the support arms 68 and 68*a* and thereby move the weight 20 upward a distance, which is a distance equal to the translational travel of the cable 44, no matter which pin 52 is engaged to which aperture 35 along the two parallel rows of apertures 35 on the arched pathway.

As noted, any of the different configurations and components can be employed with any other configuration or component shown and described herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. An exercise machine with an apparatus for selecting an amount of weight to be lifted by a user, comprising:

a frame;

a selection arm having a proximal end pivotally connected to the frame;

a support arm having a proximal end pivotally connected to the frame;

a weight connected to the support arm, wherein the support arm rotates as the weight is lifted;

a pin arm having a proximal end pivotally connected either to the weight or to the support arm;

a locking mechanism configured to connect a distal end of the pin arm to a plurality of different positions along the length of the selection arm; and a cable connected to the selection arm, wherein tension applied to the cable lifts the selection arm which in turn lifts the weight.

2. The exercise machine of claim 1, wherein the locking mechanism comprises a pin on the pin arm received into an aperture on the selection arm.

3. The exercise machine of claim 2, wherein a handle on the locking mechanism is rotated to retract a pin from the apertures.

4. The exercise machine of claim 1, wherein the cable is connected to the distal end of the selection arm.

5. The exercise machine of claim 1, wherein the selection arm has a plurality of apertures extending therealong.

6. The exercise machine of claim 5, wherein the plurality of apertures comprises two rows of apertures.

7. The exercise machine of claim 6, wherein the apertures in the two rows of apertures are staggered from one another.

8. The exercise machine of claim 5, wherein the plurality of apertures are spaced progressively farther apart as they approach the distal end of the selection arm.

9. The exercise machine of claim 5, wherein the locking mechanism biases the pin into one of the plurality of apertures on the selection arm.

10. The exercise machine of claim 1, wherein the selection arm is curved.

11. The exercise machine of claim 1, wherein the selection arm has a slot extending therealong.

12. The exercise machine of claim 1, wherein the selection arm comprises at least one row of apertures that are spaced progressively farther apart as they approach the distal end of the selection arm.

13. The exercise machine of claim 1, wherein the selection arm comprises two rows of apertures that are staggered from one another.

14. The exercise machine of claim 1, wherein the proximal ends of the selection and support arms are both connected to a first side of the frame.

15. The exercise machine of claim 1, wherein the proximal end of the pin arm is connected to the weight.

16. The exercise machine of claim 1, wherein the proximal end of the pin arm is connected to the support arm.

17. The exercise machine of claim 1, wherein the cable lifting the selection arm in turn lifts the pin arm which in turn lifts the weight.

18. The exercise machine of claim 17, wherein the locking mechanism biases the pin into an aperture on the selection arm.

19. The exercise machine of claim 1, wherein the weight is disposed on either side of the support arm.

20. The exercise machine of claim 19, wherein the weight comprises two or more flat panel weights mounted on opposite sides of the support arm.

21. The exercise machine of claim 1, further comprising:

a mounting bar connected to the support arm to receive free weights thereon.

22. The exercise machine of claim 1, further comprising:

a gear and motor for adjusting the position of the distal end of the pin arm along the length of the selection arm.

23. The exercise machine of claim 22, further comprising:

a remote control for controlling operation of the gear and motor.

24. The exercise machine of claim 1, further comprising:

a second support arm having a proximal end pivotally connected to the frame and a distal end connected to the weight, wherein the support arm and the second support arm rotate in parallel as tension on the cable raises the weight.

25. The exercise machine of claim 1, further comprising:

a secondary weight moveably positionable along the length of the selection arm.

26. The exercise machine of claim 1, wherein the proximal ends of the selection arm and the support arm are both connected to a first side of the frame and wherein a distal end of the selection arm extends beyond a second side of the frame.

27. The exercise machine of claim 1, wherein the locking mechanism holds the distal end of the pin arm adjacent to the selection arm whether the locking mechanism is locked or unlocked.

28. The exercise machine of claim 1, wherein the locking mechanism holds the distal end of the pin arm adjacent to the selection arm as the distal end of the pin arm is moved to various positions along the length of the selection arm.

29. The exercise machine of claim 1, wherein the selection arm has a slot extending therealong, and wherein a portion of the locking mechanism extends into the slot.

30. The exercise machine of claim 29, wherein the locking mechanism comprises a roller received into the slot.

31. The exercise machine of claim 1, wherein the distance of travel of the cable equals the height the weight is raised.

32. The exercise machine of claim 1, wherein the distal end of the pin arm can be locked into a position on the selection arm such that the distance of travel of the cable equals the height the weight is raised by pulling on the cable.

* * * * *